United States Patent [19]

Pittman et al.

[11] Patent Number: 4,892,356

[45] Date of Patent: Jan. 9, 1990

[54] CHAIR SHELL

[75] Inventors: Ernest A. Pittman, Courtland; Edward R. Dandridge, Senatobia, both of Miss.; Robert L. Wilson, Memphis, Tenn.

[73] Assignee: Chromcraft Furniture Corp., Senatobia, Miss.

[21] Appl. No.: 224,936

[22] Filed: Jul. 27, 1988

[51] Int. Cl.[4] ..... A47C 7/00

[52] U.S. Cl. ..... 297/457; 297/460; 297/DIG. 2

[58] Field of Search ..... 297/295, 299, 300, 309, 297/457, 460, DIG. 2

[56] References Cited

U.S. PATENT DOCUMENTS

| | | | |
|---|---|---|---|
| 2,530,924 | 11/1950 | Turner | 297/457 |
| 2,982,342 | 5/1961 | Liljengren | 297/299 |
| 4,418,958 | 12/1983 | Watkin | 297/457 |
| 4,533,174 | 8/1985 | Fleishman | 297/457 X |

*Primary Examiner*—Peter R. Brown

*Attorney, Agent, or Firm*—Wolf, Greenfield & Sacks

[57] ABSTRACT

A one-piece shell for chairs made of a semi-rigid structural material. A plurality of parallel slots in the shell extend rearwardly from the seat section across the transition section and up the back section to form parallel ribs from the rear of the seat section into the back section. The ribs are corrugated to enable them to expand and twist individually to change the contours of the shell to accommodate different body shapes and movements.

18 Claims, 6 Drawing Sheets

CHAIR SHELL

INTRODUCTION

This invention relates to chairs and more particularly comprise a new and improved shell construction for chairs having a unitized seat and backrest.

At the present time, a variety of shell-type chairs are marketed by a number of different manufacturers, which have a unitized seat and backrest. One well known chair of this type is shown in U.S. Pat. No. 4,529,247 assigned to Herman Miller, Inc. The chair shown in the '247 patent has a molded shell that has an H-shaped slot provided in the transition region that joins the back and seat. The H-shaped slot provides flexibility in the body support area at the rear of the seat and the lower portion of the back by cantilevering sections of the seat and back in the direction of the transition region. The H-shaped slot provided in the shell is not covered by the cushion or upholstery so that the slot is exposed in the finished chair. Consequently, variations in the design of a chair are somewhat limited, and any distortions of the shell to accommodate the particular body shape or movement of the occupant is visible. Furthermore, the upholstering of the chair is more complex than in chairs free of such slots, which is reflected in the relatively high cost of those chairs.

The principal object of the present invention is to provide a one-piece chair shell which is sufficiently pliable to accommodate comfortably different body sizes and position changes of the chair occupant.

Another important object of the present invention is to provide a one-piece shell for chairs, which possesses sufficient flexibility to comfortably accommodate the chair occupant, but which does not have exposed slots or other features which limit the chair design or expose shell distortions.

Another important object of this invention is to provide a one-piece shell chair which may be upholstered with a conventional sack type upholstery that may be stapled in place, so as to limit manufacturing costs.

Another object of the present invention is to provide a one-piece shell for chairs, which is specially configured to possess the flexibility necessary for comfortable seating without diminishing the structural integrity of the shell.

To accomplish these and other objects, chairs constructed in accordance with this invention include a one-piece shell having seat and back sections joined by a generally curved transition section. A plurality of generally parallel slots are provided in the shell that extend from the rear portion of the seat section across the transition section and vertically upwardly approximately half-way up the back section so as to define a plurality of generally parallel ribs. Horizontal corrugation are provided in the ribs and allow deformation such as twisting, bending or lengthening of the ribs. The entire shell including the ribs and slots is covered both on the front and back by a foam cushion and a sack-type upholstery. Holes are provided in the shell to facilitate attachment of a variety of different bases and armrests to the upholstered and cushion covered shell.

These and other object and features of the present invention will be better understood and appreciated from the following detailed description of one embodiment thereof, selected for purpose of illustration and shown in the accompanying drawings.

BRIEF FIGURE DESCRIPTION

DETAILED SPECIFICATION

Figure 1:
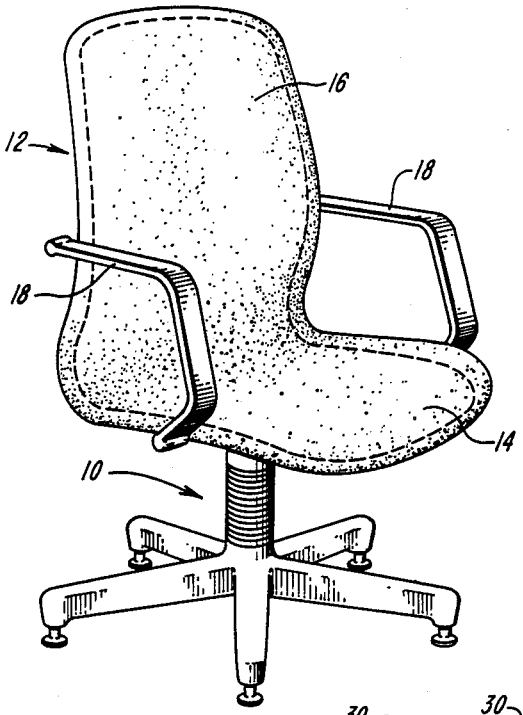
FIG. 1 is a perspective view of a chair constructed in accordance with this invention.

The chair shown in FIG. 1 embodying the present invention has a pedestal base 10 that carries a unitary body support 12 having a seat 14, backrest 16 and a pair of armrests 18. The body support 12 includes a shell 20 shown in detail in FIGS. 2–11. The shell is made of a structural material such as fiberglass reinforced chemical coupled polypropylene with modifiers and may vary in thickness from approximately 3/16 to ⅝ inch, and it has sufficient strength to totally support the body of the occupant of the chair. Nevertheless, the shell possesses enough flexibility to conform to the torso of the occupant, accommodate changes in body position, and to provide the proper orthopedic support to promote healthy posture. As is described more fully below, the major portion of the shell is ¼ inch thick, but the thickness is slightly less at the transition region between the seat and back, and the shell is significantly thickened along portions of the side edges to a maximum of approximately ⅝ inch. In one acceptable construction, a 5 inch flex was measured in the back approximately 16 inches above the seat under an applied load of 75 pounds.

Shell 20 has a seat section 22, back section 24 and transition section 26. The transition section 26 is generally curved through an arc of approximately 90° to join the rear of the seat section 22 and the lower end of the back section 24. The seat and back sections are slightly concave as viewed from above and the front, respectively, and as shown in FIGS. 8–11. A plurality of generally parallel slots 28 are formed in the shell 20 and extend from the rear of the seat section 22 through the transition section 26 to approximately the midportion of the back section 24 about 10 inches above the seat. The slots are approximately equidistantly spaced from one another and form a plurality of parallel ribs 30 between adjacent slots. In the embodiment shown, six slots 28 are provided in the shell which define between them five parallel ribs 30, and the center slots 28 extend forwardly in the seat section a short distance forwardly of the front ends of the other slots, as suggested at **28*b***.

In FIGS. 4 and 8–10, it will be noted that the transition section 26 of the shell and the lower portion of the back section 24 are of increased thickness along their side margins 31 outwardly of the outside parallel slots **28*a*. The thickened cross section along the side margins strengthens the shell in those areas. To reduce the shell weight and to facilitate molding of the shell, grooves 32** are provided in the front surface of the margins and grooves 34 ar provided in the back surface of the margins.

Figure 3:
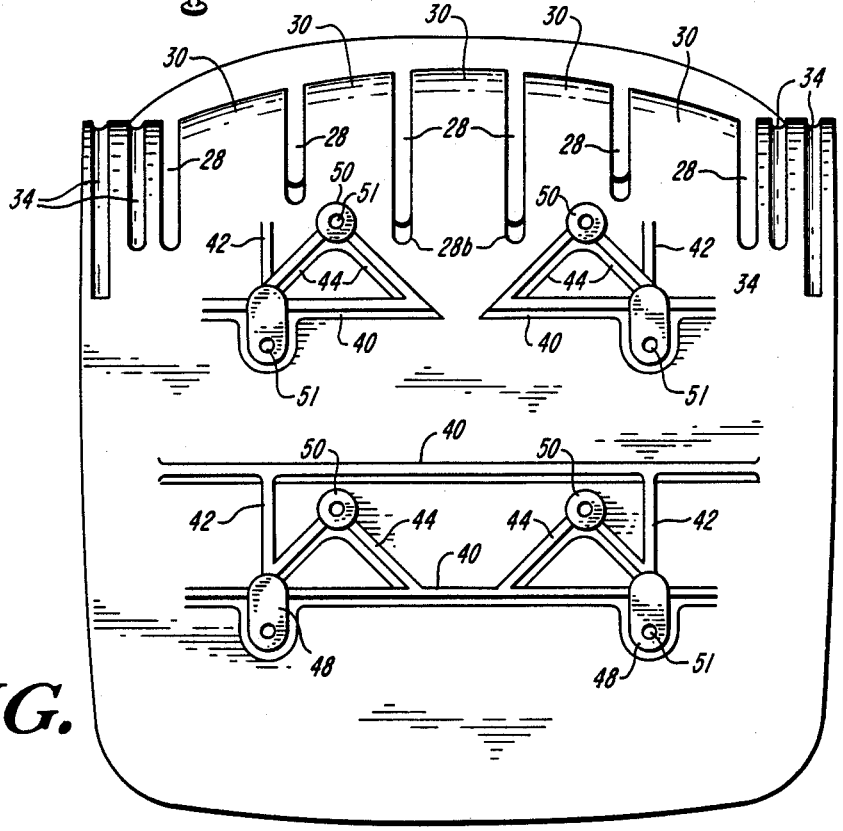
FIG. 3 is a bottom plan view of the shell shown in FIG. 2.

As is illustrated in FIG. 3, the bottom of seat section 22 is strengthened by transverse ribs 40, longitudinally extending ribs 42, and V-shaped ribs 44 integrally molded as part of the shell. The ribs join the several bosses 48 and 50 to which the pedestal or other leg structure of the chair is secured. The bosses 48 and 50 include through holes 51 by which the pedestal base or other structure may be bolted to the shell. It is to be understood that the specific location of the bosses and ribs may be dictated by the particular configuration of the support and hardware of the base. The bosses and ribs provide sufficient stiffness at the normal stress points of the shell so as to prevent the seat section 22 of the shell from fracturing when subjected to the bending and twisting forces imposed on it particularly at the points of connection to the support by the chair occupant during normal use. When the seat and back are to be supported on a pedestal base as in FIG. 1, the bosses 48 and/or 50 may be used. The bosses lie within the projections of the slots 28*a* and forwardly of the front ends of the slots 28.

Figure 2:
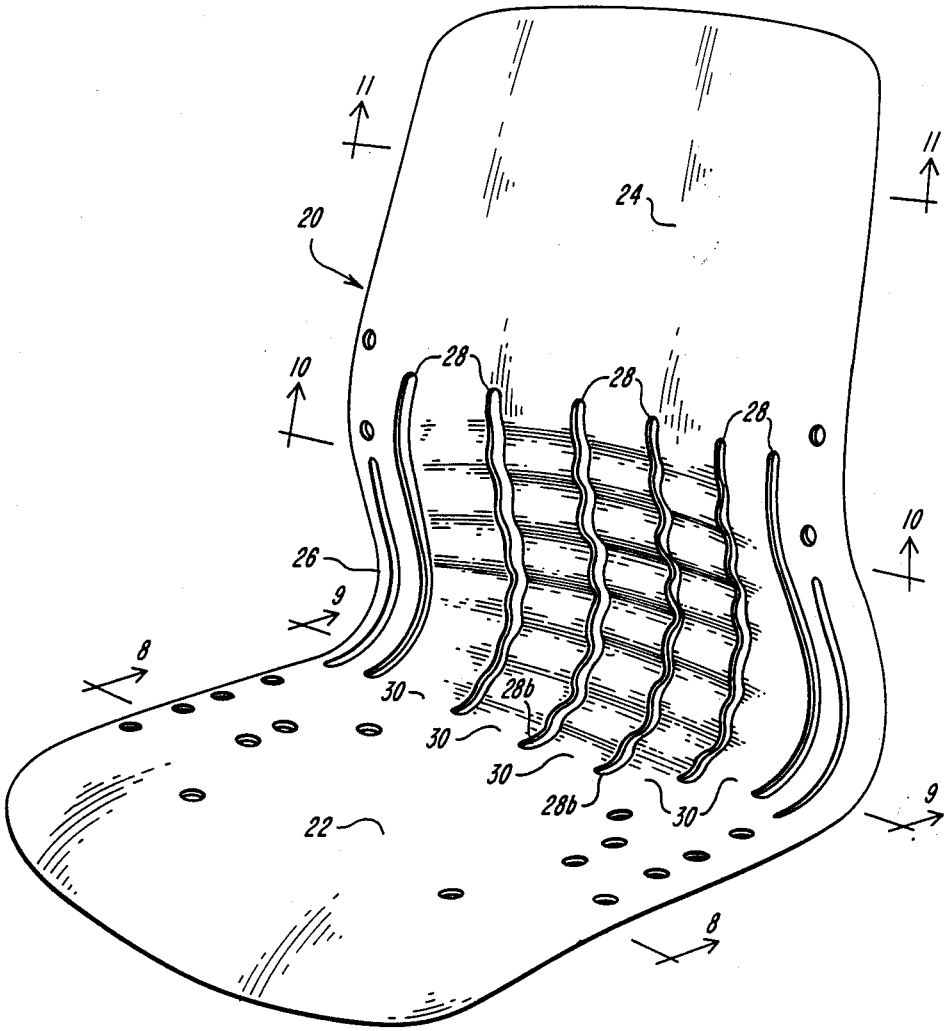
FIG. 2 is a perspective view on an enlarged scale of the shell of the chair shown in FIG. 1.
Figure 4:
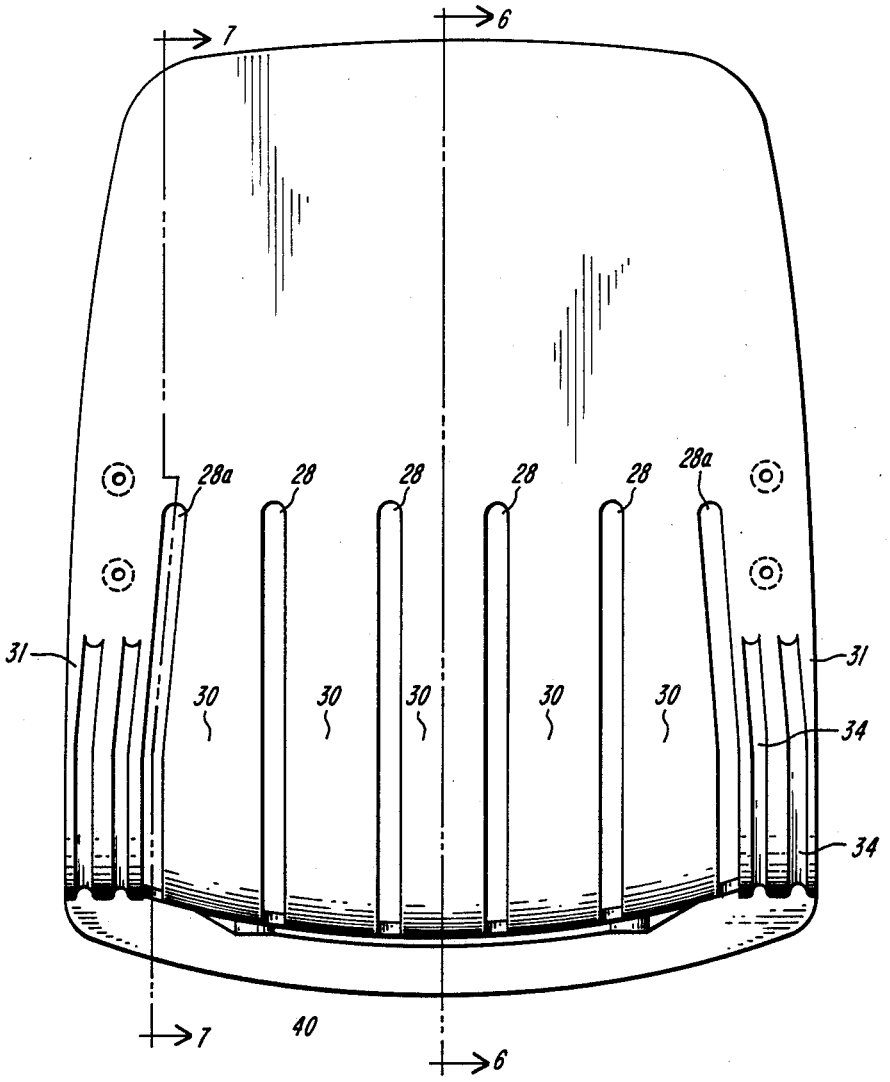
FIG. 4 is a rear elevation view of the shell shown in FIG. 2.

As shown in FIG. 2, the three central ribs 30 are corrugated substantially throughout their full length. The corrugations may be arcs of approximately ½ inch radii, and the individual undulations are somewhat deeper at the transitional section and diminish in depth towards the ends of the ribs 30 as observed from both the concaved and convex sides.

In the embodiment of shell shown in the drawing, a pair of holes 60 are provided above the upper ends of the grooves 32 and 34, which extend through the central portion of the back section 24 at the approximate level of the top ends of the slots 28. A similar array of holes 62 is provided on each side of the seat section 22. The holes 60 and 62 enable hardware to be secured to the bottom of the back and seat and which in turn support the top and bottom ends of the arm rest 18. It will be appreciated that different arm configurations will call for different hole locations, and their location and number do not limit the scope of this invention.

Figure 5:
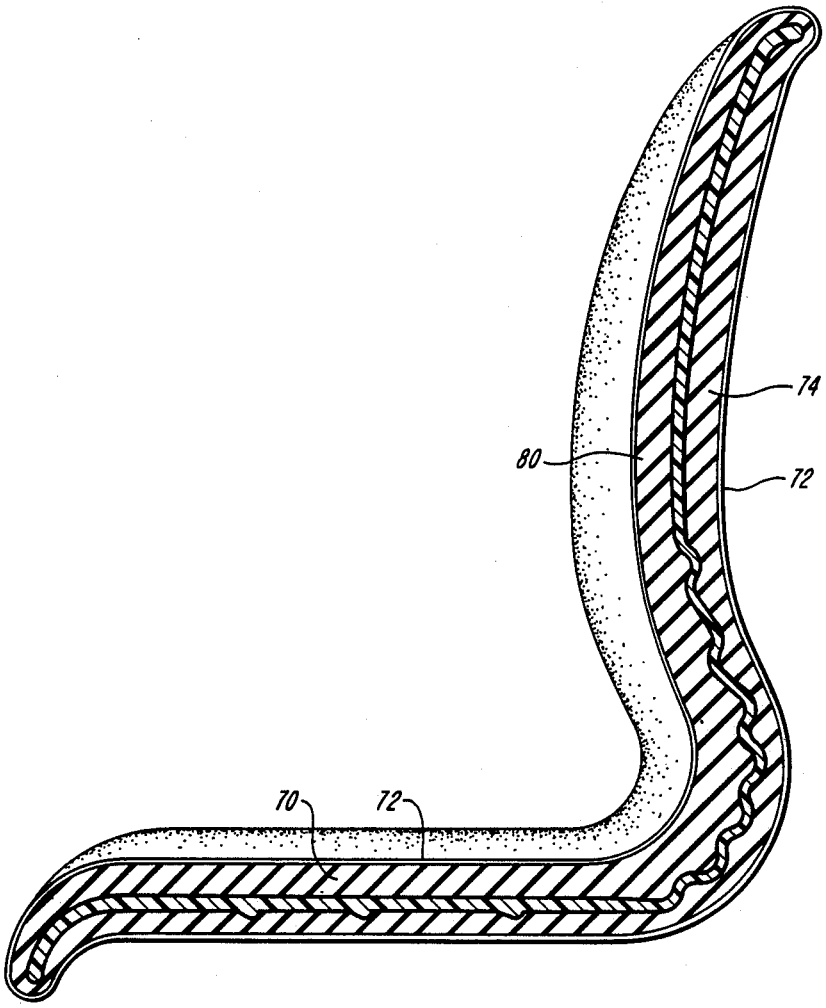
FIG. 5 is a cross-sectional view of the seat and backrest assembly of the chair, taken along a vertical plane through the center thereof, and showing the shell, cushion and upholstery of the assembly.
Figure 6:
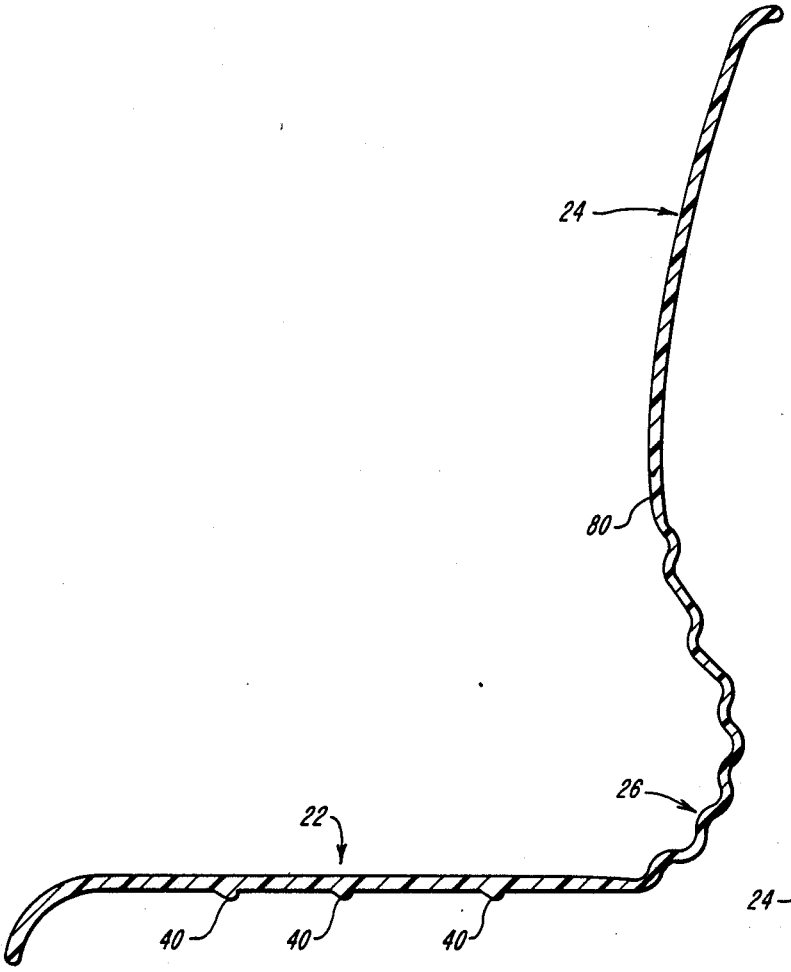
FIGS. 6 and 7 are cross-sectional views through the shell of the seat and backrest assembly, taken along the corresponding section lines in FIG. 4.
Figure 7:
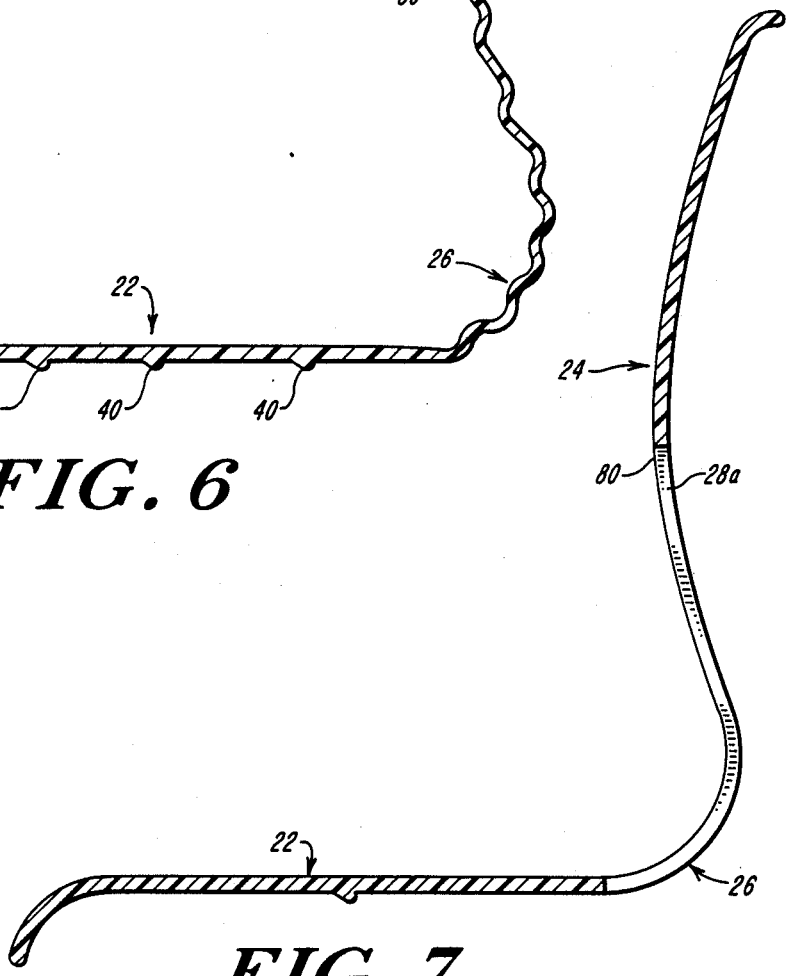
Figure 8:
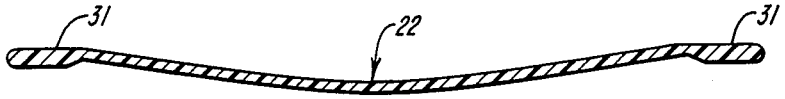
FIGS. 8–11 are cross-sectional views taken along the corresponding section lines in FIG. 2.
Figure 9:
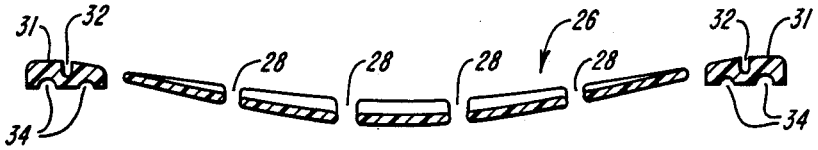
Figure 10:
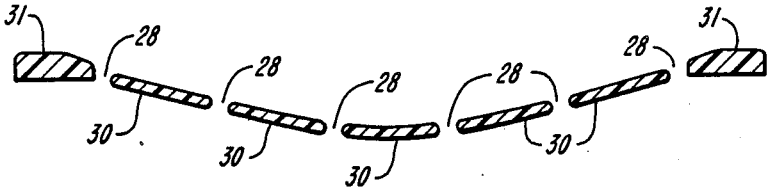
Figure 11:
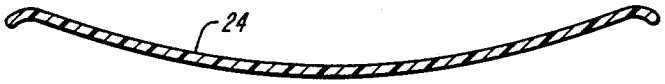

As shown in FIG. 5, a foam cushion 70 covers the front and back of the entire shell 20, and the cushion and shell in turn are covered by the upholstery covering 72. The cushion 70 may be applied to the shell 20 by well-known molding techniques, and the fabric covering may be presewn and then slipped over the foam covered shell and stapled in place. The cushion and upholstery fabric together totally mask the slots, grooves and corrugations in the shell, and the cushion provides a smooth, comfortable surface. The foam cushion 72 is sufficiently thick and possesses enough body so as to screen any impact from the undulations to the posterior of the occupant. The foam typically may be a high resiliency 80/20 blend of TDI/MDI polyurethane, 3.5# density, 35 to 40# compression at 25% I.F.D.

It will be appreciated that the material and geometry of the corrugations of the ribs enable the shell to twist, expand in the region of the ribs 30 or assume curvatures different from that of the shell in the unloaded condition. For example, one or more of the ribs 30 can expand when forces are applied to it pushing the rib rearwardly out of the biased shaped in which it is molded because the corrugations can decrease in height and effectively lengthen the ribs. The separate ribs may do this independently of one another. Similarly, each of the ribs may twist somewhat about its longitudinal axis because the effective length of each side edge of each rib may be increased. Thus, the shell is anatomically designed to move as the occupant moves, but the shell distortions are not visible to the user. Furthermore, the design of the corrugated ribs reduces the rigidly and stress concentration across the transition section of the chair that is in inherent in other designs of shell chairs.

The shape of the shell with its foam cushion and covering provides both upper back support and lower lumbar support to equalize the pressure at the base of the spine. The lumbar support is derived from the convex curvature of the back when viewed in a vertical plane as shown at 80 in FIGS. 5–7.

Those skilled in the art will appreciate that numerous modifications of the illustrated embodiment may be made without departing from the spirit of the invention. Therefore, the breadth of this invention is not to be limited to the single embodiment illustrated and described. Rather, its scope is to be determined by the appended claims and their equivalents.

We claim:

1. A chair which provides resilient flexing of the backrest and seat to accommodate occupants of different size and shape as well as movement of the occupant comprising a one piece structurally resilient chair shell having seat and back sections joined by a generally curved transition section, said back section having a contoured portion for supporting the back, a plurality of generally parallel slots in the shell extending rearwardly from the rear portion of the seat section across the transition section and vertically approximately half way up the back section so as to define a plurality of generally parallel ribs extending from the rear of the seat section into the back section.

a plurality of transverse corrugations formed in the ribs extending substantially throughout their length and superimposed on the contoured portion of the back section and the curved transition section, cushioning covering the front and back of the shell and spanning the slots in the shell, an upholstery cover enclosing the shell and cushioning and hiding the slots and corrugations, and a base secured to and supporting the shell.

2. A chair as described in claim 1 wherein the slots include outside slots disposed adjacent the side edges of the shell and inside slots spaced from the outside slots to form the ribs with approximately equal widths.

3. A chair as defined in claim 2 wherein the portions of the shell between the outside slots and side edges are free of corrugations.

4. A chair as defined in claim 3 wherein stiffening means are provided in the shell between the outside slots and the side edges.

5. A chair as defined in claim 3 wherein the base includes a pedestal connected to the seat forwardly of the slots.

6. A chair as defined in claim 5 wherein the pedestal is connected to the seat inwardly of the projection of the outside slots.

7. A chair as defined in claim 2 wherein there are four inside slots defining with the outside slots five corrugated ribs in the shell.

8. A chair as defined in claim 1 wherein the base includes a pedestal connected to the seat forwardly of the slots.

9. A chair as defined in claim 1 wherein the corrugations are made up of curved sections having radii of approximately 0.5 inch.

10. A chair as defined in claim 9 wherein the corrugations are deeper at the transition section than at the ends of the ribs.

11. A chair as defined in claim 1 wherein the corrugations extend laterally across the shell.

12. A one-piece shell for chairs comprising integral seat, back and transition sections made of a semi-rigid structural material, said back section having a contoured portion for supporting the back, a plurality of generally parallel slots in the shell extending rearwardly from the rear portion of the seat section across the transition section and vertically approximately half way up the back section so as to define a plurality of generally parallel ribs extending from the rear of the seat section into the back section.

and a plurality of transverse corrugations formed in the ribs and superimiposed on the contoured portion of the back section enabling the ribs to expand and twist so as to change the general contour of the shell so as to accommodate different body shapes and movements of the occupant.

13. A chair shell as defined in claim 13 wherein the corrugations extend horizontally across the ribs over substantially the full length of the ribs.

14. A one-piece shell for chairs comprising integral seat, back and transition sections made of a semi-rigid structural material, said back section having a contoured portion for supporting the back, a plurality of generally parallel slots in the shell extending rearwardly from the seat section across the transition section and up the back section so as to define a plurality of generally parallel ribs extending from the rear of the seat section into the back section, and a plurality of transverse corrugations formed in the ribs and superimiposed on the contoured portion of the back section enabling the ribs to expand and twist so as to change the general contour of the shell so as to accommodate different body shapes and movements of the occupant.

15. A chair shell as defined in claim 14 wherein there are approximately six slots forming five ribs in the shell.

16. In combination with a chair shell as defined in claim 15, a foam cushion covering the shell including the slots and ribs, and an upholstery cover enclosing the shell and cushion so that the slots and ribs are hidden from view.

17. A chair which provides resilient flexing of the backrest and seat to accommodate occupants of different size and shape as well as movement of the occupant comprising a one piece structurally resilient chair shell having seat and back sections joined by a generally curved transition section, said back section having a contoured portion for supporting the back, a plurality of generally parallel slots in the shell extending rearwardly from the seat section across the transition section and up the back section so as to define a plurality of generally parallel ribs extending from the rear of the seat section into the back section, a plurality of transverse corrugations formed in the ribs extending substantially throughout their length and superimposed on the contoured portion of the back section and the curved transition section, cushioning covering the front and back of the shell and spanning the slots in the shell, an upholstery cover enclosing the shell and cushioning and hiding the slots and corrugations, and a base secured to and supporting the shell.

18. A chair which provides resilient fixing of the backrest and seat to accommodate occupants of different size and shape as well as movement of the occupant comprising a one piece structurally resilient chair shell having seat and back sections joined by a generally curved transition section, said back section having a contoured portion for supporting the back, a plurality of generally parallel slots in the shell extending rearwardly from the seat section across the transition section and up the back section so as to define a plurality of generally parallel ribs extending from the rear of the seat section into the back section, a plurality of transverse corrugations extending horizontally across the ribs and superimposed on the contoured portion of the back section and the curved transition section enabling them to expand lengthwise and twist to accommodate different body sizes and position changes of the chair occupant, cushioning covering the front and back of the shell and spanning the slots in the shell, an upholstery cover enclosing the shell and cushioning and hiding the slots and corrugations, and a base secured to and supporting the shell.

* * * * *